United States Patent [19]

L'Heureux

[11] Patent Number: 4,967,529

[45] Date of Patent: Nov. 6, 1990

[54] ACOUSTICALLY INSULATING FLOOR PANEL

[76] Inventor: Ghislain L'Heureux, 911, rang St-Antoine, St Féréol Les Neiges, Canada G0A 3R0

[21] Appl. No.: 342,905

[22] Filed: Apr. 25, 1989

[51] Int. Cl.[5] ..... E04F 13/08

[52] U.S. Cl. ..... 52/390; 52/404; 52/480

[58] Field of Search ..... 52/384, 390, 480, 403, 52/592, 404

[56] References Cited

U.S. PATENT DOCUMENTS

| | | | |
|---|---|---|---|
| 2,021,348 | 11/1935 | Beckwith et al. . | |
| 3,476,634 | 11/1969 | Fleischmann . | |
| 3,499,255 | 3/1970 | Sweeney et al. | 52/403 X |
| 3,611,653 | 10/1971 | Zinn . | |
| 4,237,178 | 12/1980 | Mazaki . | |
| 4,343,127 | 8/1982 | Greve et al. | 52/232 X |
| 4,416,100 | 11/1983 | Troendle, Sr. | 52/384 X |
| 4,449,342 | 5/1984 | Abendroth | 52/480 X |
| 4,644,720 | 2/1987 | Schneider | 52/403 X |
| 4,682,459 | 7/1987 | Stephenson | 52/390 |
| 4,694,627 | 9/1987 | Omholt | 52/403 X |

FOREIGN PATENT DOCUMENTS

| | | | |
|---|---|---|---|
| 255352 | 9/1962 | Australia | 52/384 |
| 750973 | 5/1933 | France | 52/592 |
| 14527 | 10/1905 | Norway | 52/592 |
| 438599 | 11/1935 | United Kingdom | 52/390 |

*Primary Examiner*—David A. Scherbel
*Assistant Examiner*—Lan Mai
*Attorney, Agent, or Firm*—Bacon & Thomas

[57] ABSTRACT

An acoustically insulating floor panel comprises a top board having an underside. Spacing laths are mounted on the underside of the top board. A layer of fibrous, mineral wool is glued on the top board underside between the spacing laths. The panel is adhered to an already existing, supporting floor through pads made of resilient, high density polyurethane foam, self adhesive on both sides thereof, and interposed between the laths and the supporting floor.

11 Claims, 1 Drawing Sheet

ACOUSTICALLY INSULATING FLOOR PANEL

BACKGROUND OF THE INVENTION

1. Field of the invention:

The present invention relates to a floor panel mounted on an already existing, supporting floor, for acoustic insulation purposes.

2. Background of the invention:

U.S. Pat. No. 3,476,634 (FLEISCHMANN) issued on Nov. 4th, 1969, proposes an acoustically and thermally insulating floor structure designed to cover an already existing, supporting floor. More specifically, FLEISCHMANN interposes a layer of semi-rigid polyurethane foam between the supporting floor and a wooden floor covering.

The floor structure of U.S. Pat. No. 3,476,634 presents the following drawbacks.

Prior to manufacturing and assembling the floor structure, it may be necessary to treat the wood sections, segments, fingers etc. of the floor covering by immersing the same into a hot mineral oil solution, to thereby prevent warping of the wood during the hot curing of the chemical, polyurethane foam.

The layer of semi-rigid polyurethane foam is not glued nor otherwise adhered to the supporting floor. This results into a lack of adherence of the layer of polyurethane foam to the supporting floor, which lack of adherence causes after a certain time warping of the wooden floor covering even if the wood has been treated as described above by immersion in a hot mineral oil solution.

The polyurethane foam used by FLEISCHMANN can crumble and is not flexible enough to stop acoustic vibrations caused by aerial sounds as well as by impact noise. Indeed, it forms a structural interconnection for the transmission of such aerial sounds and impact noise, mainly in the range of frequencies lower than 1 kHz. However, interesting results can be obtained regarding heat insulation, and regarding acoustic insulation for aerial sounds and impact noise at higher frequencies.

OBJECT OF THE INVENTION

The main object of the present invention is to provide an acoustically insulating floor panel efficient for both aerial sounds and impact noise, and which does not present the above discussed drawbacks of the prior art.

SUMMARY OF THE INVENTION

More specifically, according to the present invention, there is provided an acoustically insulating floor panel for mounting onto an already existing, supporting floor, comprising a top board with an underside, spacing members mounted on the underside of the top board, and pad means made of resilient material interposed between the spacing members and the supporting floors. The spacing members form an air space between the top board and the supporting floor, which air space has a thickness adequate to give to the frequency mass-air-mass at which acoustic waves are transmitted from one of the top board and supporting floor to the other of the latter board and floor, a value located outside of a frequency range of interest in floor acoustic insulation. The pad means are adhered to both the spacing members and supporting floor, they are distributed over the surface covered by the said floor panel, and cover a total surface adequate to allow the resilient material to support the panel and a charge on this panel while keeping its resiliency.

Preferably, the acoustically insulating floor panel further comprises acoustically insulating fibrous wool glued on the underside of the top board and filling at least in part the air space between the top board and the supporting floor, whereby acoustic waves reaching the air space set the fibers of the wool in vibration to convert into heat energy from such acoustic waves.

In accordance with a preferred embodiment of the invention, the pad means include a plurality of individual pads distributed over the surface covered by the floor panel and cut from a sheet of high density polyurethane foam self adhesive on both sides thereof, whereby each pad has a first one of its two self adhesive sides applied on at least one of the spacing members and the second one of its two self adhesive sides applied on the supporting floor.

As can be appreciated, the floor panel is connected to the supporting floor only through the pads of high density polyurethane foam of which the resiliency absorbs the energy of acoustic waves caused by impact on the top board and by aerial sounds. Accordingly, no structural interconnection exists between the panel of the invention and supporting floor which would cause transmission of acoustic vibrations.

The objects, advantages and other features of the present invention will become more apparent upon reading of the following non restrictive description of a preferred embodiment thereof, given in conjunction with the accompanying drawings.

DETAILED DESCRIPTION OF THE PREFERRED EMBODIMENT

Figure 1:
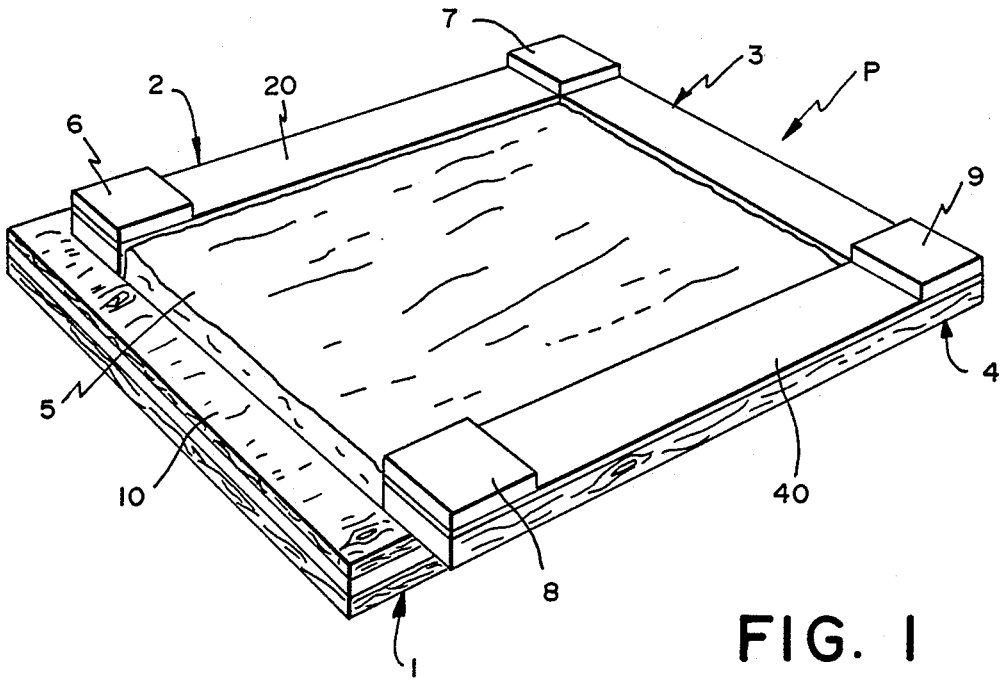
FIG. 1 is a bottom, perspective view of an acoustically insulating floor panel in accordance with the invention.
Figure 2:
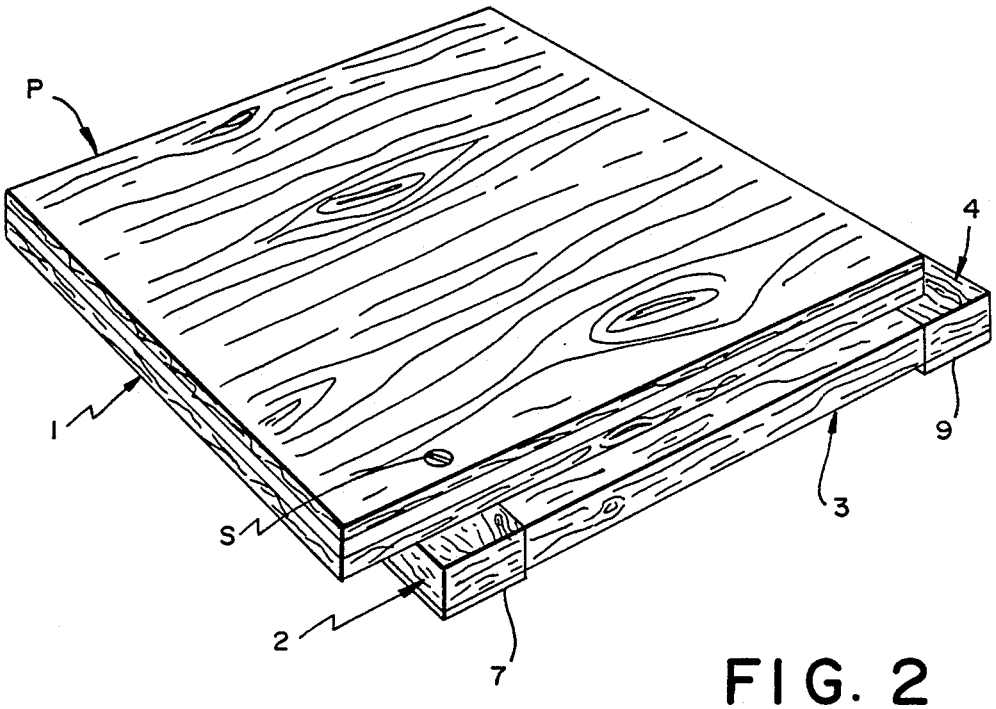
FIG. 2 is a top, perspective view of the floor panel of FIG. 1.

As shown in FIGS. 1 and 2, the acoustically insulating floor panel P comprises a square or rectangular top board 1 as well as three spacing laths 2, 3 and 4 tightly glued and screwed on the underside 10 of the board 1. The laths 2, 3 and 4 are glued and screwed to become integral with the board 1 for acoustic insulation performance purposes (the board 1 will damp vibrations of the laths tightly glued and screwed thereon).

The laths 3 and 4 are mounted on the periphery of the underside 10 with a half of their width extending outside of the board underside. Also, the lath 4 is of a length equal to that of the corresponding edge of the board 1, but is longitudinally shifted with respect to the latter board again by a half of its width. The lath 2 is parallel to the lath 4, and again, it has a length equal to that of the corresponding edge of the board 1 but is longitudinally shifted in the same direction as the lath 4 with respect to the latter board by a half of its width. The lath 2 is finally transversally shifted toward the inside of the board underside 10 by a half of its width. The lath 3 interconnects the ends of the laths 2 and 4 extending outside the board underside 10.

As can be appreciated from FIGS. 1 and 2, the floor panel P according to the invention presents four rabetted edges obtained by shifting the lath assembly 2, 3 and 4 with respect to the board 1 in two perpendicular directions.

A layer 5 of acoustically insulating fibrous mineral wool is glued on the underside 10 of the board 1 and covers the rectangular portion of this underside 10 between the different laths 2, 3 and 4. The thickness of the layer of wool corresponds substantially to the thickness of the three laths 2, 3 and 4.

Two pads 6 and 7 self adhesive on both sides thereof are applied on the underside 20 of the lath 2 at the two ends thereof, respectively, while two pads 8 and 9 also self adhesive on their two sides are applied on the underside 40 of the lath 4 at the two ends of the latter, respectively.

The illustrative example of FIGS. 1 and 2 shows the basic structure of an acoustically insulating panel in accordance with the present invention. Such a panel can of course have any desired dimensions. With larger panels, additional spacing laths are mounted on the board underside 10 between the peripheral laths such as 2, 3 and 4. Such additional laths form any pattern suitable to provide for adequate support of the top board 1. Additional pads similar to the pads 6, 7, 8 and 9 are also applied on the underside of the peripheral and additional laths whereby the panel P is attached to the supporting floor and is supported by the resilient pads at a plurality of points distributed over the surface covered by such larger panels.

The floor panel P according to the invention is mounted on an already existing, supporting concrete or wood floor by applying the adhesive undersides of the pads such as 6 to 9 on such a supporting floor.

The above described rabbetted edges of adjacent acoustically insulating floor panels P in accordance with the invention are mated together to form rabbet joints between these adjacent panels P during mounting of the latter panels on the supporting floor. The edge portions of each board 1 overlapping the laths of adjacent panels P in the rabbet joints are tightly glued and screwed on the latter laths. The screws must not extend under the laths to reach the supporting floor, as acoustic short circuits would then be produced between the panels P and the supporting floor. The so assembled panels P form a uniform and homogeneous structure improving the acoustic insulation characteristics of the resulting floor.

The laths 2, 3 and 4 are advantageously cut from a plywood board of ¾" thickness minimum. The laths can even be thicker if the height of the appartment permits it.

To increase the resistance of the board 1 to flexion, it can be laminated, that is formed by an upper board of plywood, a middle board of gypsum and a lower board of plywood tightly glued and screwed together. Screws such as S (FIG. 2) are advantageously drived from the top of the panel to attach all together the upper plywood board, the middle gypsum board, the lower plywood board, and the laths such as 2, 3 and 4. Again, it is important that the screws S do not reach the supporting floor to cause acoustic short circuits between the panels P and this supporting floor. Another advantage of the laminated structure of the board 1 is that the board of gypsum makes the board 1 heavier and accordingly more difficult to be set into vibration. Also, the plywood and gypsum boards have different coincidence frequencies whereby when the plywood boards tend to vibrate the gypsum board damps such vibrations and vice versa. It should be pointed out that "coincidence frequency" means the frequency at which an acoustic wave sets a given material into vibration.

When the panels according to the invention are to be covered with a wooden floor covering, in particular wooden battens, the board 1 can be a regular board of plywood of ⅜" thickness.

In the manufacture of the board 1 and laths 2, 3 and 4, a plurality of other materials presently available on the market can of course be used, as it will be apparent to those skilled in the art.

When acoustically insulating panels P according to the invention are mounted on the supporting floor, it can be appreciated that an air space exists between the latter supporting floor and the top boards 1, which air space being due to the pads 6 to 9 but mostly to the laths 2, 3 and 4. This air space is of thickness (given by the thickness of the laths 2–4) suitable to cause a small mass-air-mass frequency $f_{mam}$ which produces no resonance in the overall floor structure within the frequency range of interest, namely from 100 Hz to 3150 Hz. It should be reminded that the frequency $f_{mam}$ is the frequency at which acoustic vibrations are transmitted from the board 1 to the supporting floor, or vice versa, through the air of the above-mentioned space between them.

As most of the space of air between the board 1 and the supporting floor is filled with the wool 5, sound waves reacting this air space are greatly attenuated through absorption of their energy by the wool. More specifically, the energy of the sound waves sets in vibration the fibers of the wool to convert such energy into heat.

The criteria to take into consideration in selecting the material, the number, and the surface of the pads 6, 7, 8 and 9 will be given hereinbelow.

First of all, the adhesive on the two sides of each pad 6, 7, 8 and 9 must be strong enough to prevent unsticking of the pads from the laths 2, 3 and 4 as well as from the supporting floor. That would cause misalignment of the different top boards and even pulling out of the panels.

Moreover, the material of the pads 6 to 9 must be flexible enough to give to the floor structure formed by the panels P a natural frequency of resonance which is sufficiently low to provide for a good degree of vibratory insulation. Flexibility of the pads also allows the latter to absorb vibratory, mechanic and acoustic energy.

High density polyurethane foam is resilient enough to constitute the material of the different pads 6 to 9. Such a foam must however be used in its linear field of elasticity to prevent compacting of the foam which would then loose its acoustic insulation properties.

To remain within its linear field of elasticity, the charge on the polyurethane foam must not exceed a certain weight value by square inch, which value can usually be determined from the manufacturers' data. The latter value can also be determined by experimentation.

Selection of the pads 6 to 9 first involves determination of the charge or load to be supported by the floor panels P, to which is added the weight of the panels of the invention themselves, in order to obtain of value of total charge.

Using this total charge value, and the weight value the polyurethane foam can support by square inch while remaining in its linear field of elasticity, one can determine the required surface and the number of the pads, for a foam material of given density. For different charges, one can select foam materials of different densities and determine the surface covered by the pads taking into consideration the elastic characteristics of the polyurethane foam, as described hereinabove.

Each panel P of FIGS. 1 and 2 must at least include the illustrated four corner pads while larger panels must include the four corner pads and additional pads applied on the underside of the above-mentioned peripheral and additional spacing laths. The number of the pads, the surface covered by these pads and the distribution thereof over the surface covered by the panel are determined in accordance with the requirements of each given application.

As an example, pads cut from a ¼" sheet of high density polyurethane foam having the following characteristics can be used in the present invention:

| | | | | |
|---|---|---|---|---|
| Density | 15 | 20 | 30 | ASTM* 3574 |
| Compression Set | <2% | <2% | <2% | ASTM 1667 at 23° C. |
| Compression Force Def. PSI | 9–14 | 15–23 | 30 | 25% ASTM 3574 |
| Tensile Strength PSI min. | 95 | 150 | 250 | to 0.1 in./min. Strain Rate |
| Total mass load Surface/vol. | 0.9 | 0.9 | 0.9 | ASTM ES95 at 20° C. |

*American Society for Testing and Materials.

The panels P according to the invention are particularly efficient in preventing transmission of noise produced by impact on the board 1, but are also efficient in stopping aerial sound waves.

Although the present invention has been described in detail hereinabove by way of a preferred embodiment thereof, any modification to such a preferred embodiment, within the scope of the appended claims, can be carried out without departing from the spirit of the subject invention.

What is claimed is:

1. An acoustically insulating floor panel for mounting onto an already existing, supporting floor, comprising:

a top board with an underside;

spacing members mounted on the underside of the top board to form an air space between said top board and supporting floor, said air space having a thickness adequate to give to the frequency mass-air-mass at which acoustic waves are transmitted from one of the top board and supporting floor to the other of the latter board and floor, a value located outside a frequency range of interest in floor acoustic insulation;

pad means made of resilient material, interposed between said spacing members and said supporting floor, adhered to both said spacing members and said supporting floor, distributed over the surface covered by said floor panel, and covering a total surface adequate to allow said resilient material to support the panel and a charge on said panel while keeping its resiliency; and acoustically insulating fibrous wool glued on the underside of said top board and filling at least in part the air space between said top board and supporting floor, whereby acoustic waves reaching said air space set the fibers of said wool in vibration to convert into heat energy from such acoustic waves.

2. An acoustically insulating floor panel as defined in claim 1, in which said spacing members comprise elongated laths having a given thickness and mounted on the underside of said top board.

3. An acoustically insulating floor panel as defined in claim 2, in which said laths are tightly glued and screwed on the underside of said top board.

4. An acoustically insulating floor panel as defined in claim 2, wherein said top board and spacing laths are cut from larger plywood boards.

5. An acoustically insulating floor panel as defined in claim 1, wherein said top board is a laminated board comprising at least two layers having different coincidence frequencies.

6. An acoustically insulating floor panel as defined in claim 5, in which said top, laminated board is formed of an upper board of plywood, a middle board of gypsum, and a lower board of plywood tightly glued together.

7. An acoustically insulating floor panel as defined in claim 1, wherein said pad means comprise a plurality of individual pads distributed over the surface covered by the said floor panel and cut from a sheet of said resilient material self adhesive on both sides thereof, whereby each pad has a first one of its two self adhesive sides applied on at least one of said spacing members, and the second one of its two self adhesives sides applied on the supporting floor.

8. An acoustically insulating floor panel as defined in claim 7, in which said resilient foam material is made of high density polyurethane.

9. An acoustically insulating floor panel as claimed in claim 1, in which said panel comprises rabbet edges for mating with adjacent rabbet edges of similar panels to thereby produce rabbet joints between the said panels.

10. An acoustically insulating floor panel for mounting onto an already existing, supporting floor, comprising:

a top board with an underside;

spacing members comprising elongated laths having a given thickness and mounted on the underside of the top board to form an air space between said top board and supporting floor, said air space having a thickness adequate to give to the frequency mass-air-mass at which acoustic waves are transmitted from one of the top board and supporting floor to the other of the latter board and floor, a value located outside a frequency range of interest in floor acoustic insulation;

pad means made of resilient material, interposed between said spacing members and said supporting floor, adhered to both said spacing members and said supporting floor, distributed over the surface covered by said floor panel, and covering a total surface adequate to allow said resilient material to support the panel and a charge on said panel while keeping its resiliency; and a layer of acoustically insulating fibrous wool is glued on the underside of said top board between said spacing laths, said layer of wool being located in the said air space and having a thickness corresponding substantially to that of the spacing laths.

11. An acoustically insulating floor panel as defined in claim 8, in which said top board is laminated and formed of (a) an upper board of plywood, (b) a middle board of gypsum, and (c) a lower board of plywood tightly glued together, the upper plywood board, the middle gypsum board, the lower plywood board, and the spacing laths being screwed all together.

* * * * *